US008460846B2

(12) United States Patent
Kunii et al.

(10) Patent No.: US 8,460,846 B2
(45) Date of Patent: Jun. 11, 2013

(54) TONER FOR ELECTROSTATIC IMAGE DEVELOPMENT

(75) Inventors: Satoshi Kunii, Wakayama (JP); Masahito Yamazaki, Wakayama (JP)

(73) Assignee: Kao Corporation, Tokyo (JP)

( * ) Notice: Subject to any disclaimer, the term of this patent is extended or adjusted under 35 U.S.C. 154(b) by 1005 days.

(21) Appl. No.: 12/053,817

(22) Filed: Mar. 24, 2008

(65) Prior Publication Data

US 2008/0241717 A1 Oct. 2, 2008

(30) Foreign Application Priority Data

Mar. 30, 2007 (JP) ..... 2007-093420

(51) Int. Cl.
*G03G 9/00* (2006.01)

(52) U.S. Cl.
USPC ..... 430/109.4; 430/124.1

(58) Field of Classification Search
USPC ..... 430/109.4, 124.1
See application file for complete search history.

(56) References Cited

U.S. PATENT DOCUMENTS

| | | | | |
|---|---|---|---|---|
| 5,330,870 | A | 7/1994 | Tanaka et al. | |
| 5,618,648 | A | 4/1997 | Horikoshi et al. | |
| 5,753,397 | A | 5/1998 | Nakayama | |
| 6,326,115 | B1 | 12/2001 | Nakanishi et al. | |
| 6,682,866 | B2 * | 1/2004 | Sugiyama et al. | 430/108.1 |
| 6,756,175 | B2 * | 6/2004 | Emoto et al. | 430/124.3 |
| 2002/0136974 | A1 * | 9/2002 | Nakamura et al. | 430/108.4 |
| 2003/0039910 | A1 * | 2/2003 | Shirai et al. | 430/109.4 |
| 2005/0095523 | A1 * | 5/2005 | Shimokusa et al. | 430/108.8 |
| 2005/0227157 | A1 * | 10/2005 | Shirai | 430/106.1 |
| 2006/0073402 | A1 * | 4/2006 | Sensui | 430/108.4 |
| 2006/0222995 | A1 | 10/2006 | Moriyama et al. | |
| 2007/0148579 | A1 * | 6/2007 | Mera et al. | 430/109.4 |
| 2007/0172751 | A1 * | 7/2007 | Kidokoro | 430/108.4 |
| 2010/0035175 | A1 | 2/2010 | Eida | |
| 2011/0212395 | A1 | 9/2011 | Aoki et al. | |

FOREIGN PATENT DOCUMENTS

| | | |
|---|---|---|
| JP | 5-107805 | 4/1993 |
| JP | 8-20636 | 1/1996 |
| JP | 8-87130 | 4/1996 |
| JP | 8-211648 | 8/1996 |
| JP | 10-239903 | 9/1998 |
| JP | 11-133668 | 5/1999 |
| JP | 2002-55485 | 2/2002 |
| JP | 2003-98726 | 4/2003 |
| JP | 2003-98875 | 4/2003 |
| JP | 2004-77577 | 3/2004 |
| JP | 2005-37926 | 2/2005 |
| JP | 2005-55858 | 3/2005 |
| JP | 2005-91436 | 4/2005 |
| JP | 2006-47879 | 2/2006 |
| JP | 2010-061115 | 3/2010 |
| JP | 2010-224255 | 10/2010 |

OTHER PUBLICATIONS

U.S. Appl. No. 12/107,441, filed Apr. 22, 2008, Yamazaki, et al.
Arguments presented Sep. 19, 2012 in corresponding Japanese Patent Application No. 2008-86900 in response to the Japanese Office Action issued Jul. 25, 2012, with English translation (9 pp.).
Japanese Office Action issued Jul. 25, 2012, in Patent Application No. 2008-086900 (with English-language translation).

* cited by examiner

*Primary Examiner* — Mark F Huff
*Assistant Examiner* — Jonathan Jelsma
(74) *Attorney, Agent, or Firm* — Oblon, Spivak, McClelland, Maier & Neustadt, L.L.P.

(57) ABSTRACT

A toner for electrostatic image development, containing a resin binder and a wax, wherein the resin binder contains an amorphous polyester obtained by polycondensing a carboxylic acid component containing fumaric acid in an amount of from 55 to 100% by mole, with an alcohol component, wherein the wax contains an ester of pentaerythritol and a fatty acid having 15 to 25 carbon atoms, and a method of forming fixed images, including the step of applying the toner for electrostatic image development to a non-contact fixing type image-forming apparatus. The toner for electrostatic image development of the present invention is suitably used for, for example, developing a latent image formed in electrophotography, electrostatic recording method, electrostatic printing method, or the like.

16 Claims, No Drawings

TONER FOR ELECTROSTATIC IMAGE DEVELOPMENT

FIELD OF THE INVENTION

The present invention relates to a toner for electrostatic image development used for, for example, developing a latent image formed in electrophotography, electrostatic recording method, electrostatic printing method, or the like, and a method of forming fixed images using the toner.

BACKGROUND OF THE INVENTION

A non-contact fixing method, such as oven fixing or flash fixing, in which a toner is fixed by applying heat or light energy to a toner in a non-contacting state, has a feature that generation of offset phenomenon and deterioration of resolution which are problematic in a contact fixing method are suppressed, or the like. Further, in a non-contact fixing method, since an unfixed image is not pressed, which is the case using a heat-roller fixing method, an even higher-quality image can be obtained.

However, since no pressure is applied to a toner in the non-contact fixing method, differently from the heat-roller fixing method, it is necessary to instantly melt the toner, and a great amount of calories are necessitated especially in high-speed machines such as one having a linear speed exceeding 750 mm/sec. Thus, improvement in the fixing ability is a serious problem to be solved. Therefore, toners for non-contact fixing using a specified resin binder are disclosed in JP-A-Hei-8-87130, JP-A-Hei-5-107805, and the like. In addition, JP-A-Hei-8-211648 discloses a toner for electrophotography containing an ester of which low-temperature fixing ability is improved, obtained from a neopentyl polyol, a dicarboxylic acid, and a long-chain linear saturated fatty acid.

In addition, it is clear that, for example, as in JP2004-77577 A, fixing ability in the non-contact fixing method can be improved by using crystalline polyester.

SUMMARY OF THE INVENTION

The present invention relates to:

[1] a toner for electrostatic image development, containing a resin binder and a wax, wherein the resin binder contains an amorphous polyester obtained by polycondensing a carboxylic acid component containing fumaric acid in an amount of from 55 to 100% by mole, with an alcohol component, wherein the wax contains an ester of pentaerythritol and a fatty acid having 15 to 25 carbon atoms; and

[2] a method of forming fixed images, including the step of applying the toner for electrostatic image development as defined in the above [1] to a non-contact fixing type image-forming apparatus.

DETAILED DESCRIPTION OF THE INVENTION

Even though a toner which is excellent in fixing ability can be produced according to JP-A-Hei-8-87130, JP-A-Hei-5-107805, JP-A-Hei-8-211648, or the like, the durability is not sufficient, thereby resulting in lowering of the image density in the durable printing. Therefore, further improvements are desired.

In addition, even though fixing ability in the non-contact fixing method can be greatly improved by using crystalline polyester, as in JP2004-77577 A, under the conditions that a lot of stress is applied to a developer, as in a high-speed two-component developing machine, there also exist disadvantages that toner spent is generated to a carrier, and triboelectric chargeability that is stable for a long period of time cannot be obtained, whereby developability is worsened.

The present invention relates to a toner for electrostatic image development, which is excellent in low-temperature fixing ability, excellent in paper rubbing property, and excellent in durability that a disadvantage such as toner spent does not take place, even when a non-contact fixing type high-speed machine is used, and a method of forming fixed images using the toner.

The toner for electrostatic image development of the present invention exhibits excellent effects that the toner shows an excellent low-temperature fixing ability and that the toner is excellent in paper rubbing property, excellent in durability that a disadvantage such as toner spent does not take place and the toner has a stable developability even in a use for a long period of time, even in an image-forming apparatus which is a non-contact fixing type high-speed machine.

These and other advantages of the present invention will be apparent from the following description.

As a result of intensive studies in order to solve the above-mentioned disadvantages, the present inventors have found a toner which is excellent in both low-temperature fixing ability and spent resistance by using an ester of pentaerythritol and a fatty acid having 15 to 25 carbon atoms in combination with a polyester resin containing a fumaric acid component. The present invention has been accomplished thereby.

One of the significant features of the present invention resides in that the present invention is a toner for electrostatic image development containing a resin binder and an ester of pentaerythritol and a fatty acid having 15 to 25 carbon atoms as a wax, wherein the toner uses a specified resin binder. The toner uses an ester of pentaerythritol and a fatty acid having 15 to 25 carbon atoms, for the reason that when a fatty acid has 15 carbon atoms or more, compatibility with polyester would not be too high, thereby maintaining a low-temperature fixing effect, and when a fatty acid has 25 carbon atoms or less, compatibility with polyester would not be too low, thereby filming and toner spent to a carrier are suppressed. In addition, the resin binder contains a polyester obtained by polycondensing a carboxylic acid component containing at least fumaric acid, with an alcohol component. The polyester uses fumaric acid as a raw material, whereby a higher-molecular polyester can be formed, as compared to a polyester obtained by using, for example, terephthalic acid, in a large amount, even the polyesters have the same level of softening points. In addition, since fumaric acid has appropriate compatibility with a fatty acid ester of pentaerythritol, it is considered that, in the melt-kneading step of the raw materials during the toner preparation, a polyester obtained by using fumaric acid can disperse a fatty acid ester of pentaerythritol in the toner more appropriately than a polyester obtained by using terephthalic acid, so that the disadvantages such as filming and toner spent can be improved.

The ester of pentaerythritol and a fatty acid having 15 to 25 carbon atoms is an ester compound of pentaerythritol and a fatty acid having 15 to 25 carbon atoms.

A fatty acid having 15 to 25 carbon atoms includes saturated or unsaturated, linear or branched fatty acid, more specifically, palmitic acid, stearic acid, arachic acid, behenic acid, lignoceric acid, oleic acid, linoleic acid, and the like. Among them, a fatty acid having 16 to 24 carbon atoms is more preferable, and a fatty acid having 17 to 23 carbon atoms is even more preferable, from the viewpoint of dispersibility and fixing ability.

The ester of pentaerythritol and a fatty acid having 15 to 25 carbon atoms can be prepared by, for example, subjecting pentaerythritol and a fatty acid to an esterification reaction, at the reaction temperature of 120° C. or more. A degree of esterification is not particularly limited, and is preferably 0.8 or more to 1.0 or less.

The ester of pentaerythritol and a fatty acid having 15 to 25 carbon atoms has an acid value and a hydroxyl value of both preferably 5 mgKOH/g or less, and more preferably from 0.1 to 3 mgKOH/g, from the viewpoint of dispersibility and environmental stability. In the present specification, an acid value and a hydroxyl value of the fatty acid ester of pentaerythritol are determined according to the method described in Examples set forth below.

The ester of pentaerythritol and a fatty acid having 15 to 25 carbon atoms in the toner has a volume-average dispersion diameter of preferably from 0.1 to 5 μm, and more preferably from 0.5 to 3 μm, from the viewpoint of fixing ability and durability of the toner. A dispersion diameter of the fatty acid ester of pentaerythritol can be adjusted by an acid value of a resin, a degree of esterification of a fatty acid ester, a kneading temperature, or the like. For example, when a kneading temperature is lowered, a dispersion diameter of ester is likely to be small.

The volume-average dispersion diameter of the fatty acid ester can be determined according to the following method.

(1) The amount 0.5 g of a resin is weighed out in a 50 ml sample tube, and 20 mL of tetrahydrofuran is added thereto. The sample tube is placed on a ball-mill loading table, and stirred for 1 hour to sufficiently dissolve the resin, to prepare a sample solution.

(2) The resulting sample solution is diluted with tetrahydrofuran until the fatty acid ester attains a determination concentration, and a volume-average dispersion diameter of the fatty acid ester is determined with a Shimadzu laser diffraction type particle distribution analyzer "SALD-2000J" (commercially available from Shimadzu Corporation).

Incidentally, when a component insoluble to the resin is found in the solution, a dropwise addition of a 1 N aqueous potassium hydroxide (KOH) solution and an ultrasonic irradiation are repeatedly carried out until the insoluble component disappears, and the above determination is carried out after it is confirmed that the insoluble component do not reside in the sample solution.

The ester of pentaerythritol and a fatty acid having 15 to 25 carbon atoms is contained in an amount of preferably from 0.1 to 10 parts by weight, and more preferably from 1 to 5 parts by weight, based on 100 parts by weight of the resin binder, and is contained in an amount of preferably from 0.1 to 8 parts by weight, and more preferably from 1 to 4 parts by weight, based on 100 parts by weight of the toner.

The toner of the present invention may properly contain a wax other than the above-mentioned wax of an ester of pentaerythritol and a fatty acid having 15 to 25 carbon atoms within the range which would not impair the effects of the present invention. The ester of pentaerythritol and a fatty acid having 15 to 25 carbon atoms is contained in an amount of preferably 50% by weight or more, and more preferably 70% by weight or more, of a total amount of the wax.

The resin binder in the present invention contains a polyester obtained by polycondensing a carboxylic acid component containing fumaric acid, with an alcohol component. Fumaric acid is contained in the carboxylic acid component in an amount of preferably 20% by mole or more, more preferably from 50 to 100% by mole, even more preferably from 55 to 100% by mole, even more preferably from 60 to 100% by mole, even more preferably from 70 to 100% by mole, and even more preferably substantially 100% by mole, from the viewpoint of appropriately dispersing the wax and improving filming resistance.

In the present invention, a carboxylic acid compound other than fumaric acid may be used within the range which would not impair the effects of the present invention. The carboxylic acid compound other than fumaric acid includes dicarboxylic acids such as phthalic acid, isophthalic acid, terephthalic acid, maleic acid, adipic acid, and succinic acid; a substituted succinic acid of which substituent is an alkyl group having 1 to 20 carbon atoms or an alkenyl group having 2 to 20 carbon atoms, such as dodecenylsuccinic acid or octenylsuccinic acid; tricarboxylic or higher polycarboxylic acids such as trimellitic acid and pyromellitic acid; acid anhydrides thereof, alkyl (1 to 3 carbon atoms) esters thereof, and the like. Among them, terephthalic acid, isophthalic acid, succinic acid, and trimellitic acid are preferable. The above-mentioned acids, acid anhydrides of these acids and alkyl esters of the acids are collectively referred to herein as a carboxylic acid compound.

The alcohol component of the polyester in the present invention includes an alkylene oxide adduct of bisphenol represented by the formula (I):

(I)

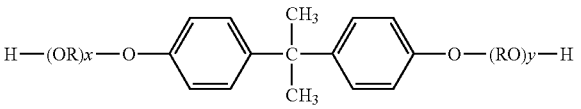

wherein RO is an alkyleneoxy group; R is an alkylene group having 2 or 3 carbon atoms; x and y are positive numbers showing an average number of moles of alkylene oxide added, wherein a sum of x and y is from 1 to 16, and preferably from 1.5 to 5, such as polyoxypropylene(2.2)-2,2-bis(4-hydroxyphenyl) propane and polyoxyethylene(2.0)-2,2-bis(4-hydroxyphenyl)propane, ethylene glycol, propylene glycol, glycerol, pentaerythritol, trimethylolpropane, hydrogenated bisphenol A, sorbitol, or an alkylene (2 to 4 carbon atoms) oxide (average number of moles: 1 to 16) adduct thereof, and the like.

Among them, the alkylene oxide adduct of bisphenol A represented by the formula (I) is preferable, from the viewpoint of durability and triboelectric chargeability of the toner. The alkylene oxide adduct of bisphenol A is contained in an amount of preferably 70% by mole or more, and more preferably 80% by mole or more, of the alcohol component.

Here, the alcohol component may properly contain a monohydric alcohol, and the carboxylic acid component may properly contain a monocarboxylic acid compound, from the viewpoint of adjusting the molecular weight and improving offset resistance.

The polycondensation of the alcohol component and the carboxylic acid component can be carried out, for example, at a temperature of from 180° to 250° C. in an inert gas atmosphere, in the presence of an esterification catalyst, for example, dibutyltin oxide, as desired.

The esterification catalyst resides in the reaction system in an amount of preferably from 0.05 to 1 part by weight, and more preferably from 0.1 to 0.8 parts by weight, based on 100 parts by weight of a total amount of the alcohol component and the carboxylic acid component.

In the present invention, it is preferable that the polyester is an amorphous polyester. The crystallinity of the polyester is expressed as an index of crystallinity as defined by a ratio of a softening point to a highest temperature of endothermic peak determined by a differential scanning calorimeter, i.e., softening point/highest temperature of endothermic peak. Generally, when an index of crystallinity exceeds 1.5, the resin is amorphous; and when an index of crystallinity is less than 0.6, the resin is low in crystallinity and mostly amorphous. Therefore, in the present invention, the amorphous polyester refers to a resin having an index of crystallinity of more than 1.5 or less than 0.6, and preferably more than 1.5. Here, the highest temperature of endothermic peak refers to a peak temperature on the highest temperature side among the endothermic peaks observed. When a difference between the highest peak temperature and the softening point is within 20° C., the peak temperature is defined as a melting point. When the difference between the highest peak temperature and the softening point exceeds 20° C., the peak temperature is ascribed to a glass transition. The crystallinity of the resin can be adjusted by the kinds of the raw material monomers and a ratio thereof, preparation conditions (for example, reaction temperature, reaction time, and cooling rate), and the like.

The polyester has a softening point of preferably from 70° to 140° C., more preferably from 80° to 130° C., and even more preferably from 90° to 120° C., from the viewpoint of fixing ability. The polyester has a glass transition temperature of preferably from 50° to 85° C., and more preferably from 55° to 80° C., from the viewpoint of fixing ability. The polyester has an acid value of preferably from 1 to 40 mgKOH/g, and more preferably from 2 to 38 mgKOH/g, from the viewpoint of dispersibility. In the present specification, a softening point, a glass transition temperature, and an acid value are determined according to the methods described in Examples set forth below.

Incidentally, in the present invention, the polyester may be a polyester that has been modified to an extent that the polyester do not substantially impair the properties. A modified polyester is exemplified by a polyester that has been grafted or blocked with phenol, urethane, epoxy, or the like according to the method described in JP-A-Hei-11-133668, JP-A-Hei-10-239903, JP-A-Hei-8-20636, or the like.

The above-mentioned polyester is contained in an amount of preferably from 70 to 100% by weight, and more preferably substantially 100% by weight, of the resin binder.

In the present invention, the resin binder has a weight-average molecular weight determined by the gel permeation chromatography (GPC) of preferably $1.0\times10^4$ or more calculated as polystyrene, from the viewpoint of appropriately maintaining dispersibility in the polyester of a fatty acid of pentaerythritol and preventing toner spent, and preferably $1.0\times10^6$ or less and more preferably $1.0\times10^5$ or less, from the viewpoint of maintaining low-temperature fixing ability. Here, the weight-average molecular weight of the resin binder refers to a weight-average molecular weight of tetrahydrofuran-soluble components of the resin binder, and is determined according to the method described in Example set forth below.

It is preferable that the toner of the present invention contains at least a colorant and a charge control agent, besides the resin binder.

As the colorant, a dye, a pigment, or the like which is used as a colorant for a toner can be used. The colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, Carmine 6B, Disazoyellow, and the like. These colorants can be used alone or in admixture of two or more kinds. The toner of the present invention may be either black toners or color toners. The colorant is contained in an amount of preferably from 1 to 40 parts by weight, and more preferably from 3 to 10 parts by weight, based on 100 parts by weight of the resin binder.

The charge control agent may be either a positively chargeable charge control agent or a negatively chargeable charge control agent, and also these may be used together. The positively chargeable charge control agent includes a Nigrosine dye, a triphenylmethane-based dye containing a tertiary amine as a side chain, a quaternary ammonium salt compound, a polyamine resin, an imidazole derivative, and the like. The negatively chargeable charge control agent includes a metal-containing azo dye, a copper phthalocyanine dye, a metal complex of an alkyl derivative of salicylic acid, boron complex of benzilic acid, and the like. The charge control agent is contained in an amount of preferably from 0.1 to 5.0 parts by weight, and more preferably from 1.0 to 4.0 parts by weight, based on 100 parts by weight of the resin binder.

Further, the toners of the present invention may properly contain an additive such as a releasing agent, an electric conductivity modifier, an extender, a reinforcing filler such as a fibrous substance, an antioxidant, an anti-aging agent, or a magnetic material.

The toner of the present invention can be produced according to a known method such as a kneading-pulverization method, a spray-drying method, or a polymerization method. A pulverized toner obtained according to the kneading-pulverization method is preferable, from the viewpoint of productivity. The pulverized toner is obtained, for example, by mixing a resin binder, a charge control agent, and a colorant, as well as various additives as desired, and the like, with a mixer such as a Henschel mixer or a ball-mill, thereafter melt-kneading with a closed kneader, a single-screw or twin-screw extruder or the like, cooling the product, thereafter roughly pulverizing with a hammer-mill or the like, further, finely pulverizing with a fine pulverizer utilizing jet stream or a mechanical pulverizer, and classifying the product to a given particle size with a classifier utilizing gyratory stream or a classifier utilizing a Coanda effect.

The external additive such as a hydrophobic silica may be externally added to a surface of the toner. As a step of treating a surface of the toner with the external additive, a dry mixing method including the step of mixing the external additive and the toner (mother toner particles) using a high-speed mixer such as a Henschel mixer or a Super mixer, a V blender, or the like is preferable. The external additive may be previously mixed and added to a high-speed mixer or a V blender, or separately added thereto.

The toner of the present invention has a volume-median particle size ($D_{50}$) of preferably from 3 to 15 μm and more preferably from 4 to 9 μm, as a particle size before adding the external additive such as an intercalation compound thereto, from the viewpoint of easiness to handle as fine particles. The term "volume-median particle size ($D_{50}$)" as used herein refers to a particle size of which cumulative volume frequency calculated on a volume percentage is 50% counted from the smaller particle sizes.

The toner particles in which the wax has a dispersion diameter of from 0.3 to 0.8 μm are contained in an amount of preferably 70% by number or more, and more preferably 80% by number or more, of the toner of the present invention. In the present invention, the term "dispersion diameter of wax" refers to a particle size in the maximum direction of a wax dispersed in the toner particles. Concretely, toner particles are embedded in an epoxy resin, ultra-thinly sliced into about 80

μm, stained with ruthenium tetroxide, and thereafter, a cross section of the toner particles is photographed with a transmission electron microscope (TEM) at a magnification of 5000 times. The cross section of the toner particles is photographed, and 100 particles of the toner in which a particle size in the maximum direction of the cross section is 5 μm or more are selected, and dispersion diameters of the wax are determined. Toner particles in which even one wax having a dispersion diameter of from 0.3 to 0.8 μm has been observed in a photograph of the cross section are counted as toner particles in which a wax has a dispersion diameter of from 0.3 to 0.8 μm. The amount of the toner particles in which the wax has a dispersion diameter of from 0.3 to 0.8 μm in 100 particles of the toner (% by number) is calculated.

The toner of the present invention has a weight-average molecular weight determined by the gel permeation chromatography (GPC) of preferably $1.0\times10^4$ or more calculated as polystyrene, from the viewpoint of appropriately maintaining dispersibility in the polyester of a fatty acid ester of pentaerythritol and preventing toner spent, and preferably $1.0\times10^6$ or less and more preferably $1.0\times10^5$ or less, from the viewpoint of maintaining low-temperature fixing ability. Here, the weight-average molecular weight of the toner refers to a weight-average molecular weight of tetrahydrofuran-soluble components of the toner, and is determined according to the method described in Example set forth below.

The toner for electrostatic image development of the present invention can be either directly used as a toner for monocomponent development in a monocomponent developing method, or used as a toner for two-component development in which the toner mixed with a carrier is used in a two-component developing method. The toner of the present invention can be suitably used as a toner for two-component development used as a two-component developer mixed with a carrier in that the toner is excellent in printing stability and capable of speeding up the printing.

As a carrier, it is preferable to use a carrier having a low saturated magnetization, which forms a soft magnetic brush, from the viewpoint of the properties of fixed images. The carrier has a saturated magnetization of preferably from 40 to 100 $Am^2/kg$, and more preferably from 50 to 90 $Am^2/kg$. A saturated magnetization is preferably 100 $Am^2/kg$ or less from the viewpoint of adjusting hardness of the magnetic brush and retaining tone reproducibility, and is preferably 40 $Am^2/kg$ or more from the viewpoint of preventing carrier adhesion and toner scattering. A saturated magnetization of the carrier is determined according to the method described in Examples set forth below.

As a core material for the carrier, a core material made from any known materials can be used without particular limitation. The core material includes, for example, ferromagnetic metals such as iron, cobalt and nickel; alloys and compounds such as magnetite, hematite, ferrite, copper-zinc-magnesium-based ferrite, manganese-based ferrite, and magnesium-based ferrite; glass beads; and the like. Among them, iron powder, magnetite, ferrite, copper-zinc-magnesium-based ferrite, manganese-based ferrite, and magnesium-based ferrite are preferable from the viewpoint of triboelectric chargeability, and ferrite, copper-zinc-magnesium-based ferrite, manganese-based ferrite, and magnesium-based ferrite are more preferable from the viewpoint of image quality.

The surface of the carrier is preferably coated with a resin from the viewpoint of reducing staining on the carrier. The resin for coating the surface of the carrier varies depending upon the materials for the toner. The resin includes, for example, a fluororesin such as a polytetrafluoroethylene, a monochlorotrifluoroethylene polymer, and a poly(vinylidene fluoride); a silicone resin such as a polydimethylsiloxane; a polyester; a styrenic resin; an acrylic resin; a polyamide; a polyvinyl butyral; an aminoacrylate resin; and the like. These resins can be used alone or in admixture of two or more kinds. When the toner is negatively chargeable, a silicone resin is preferable from the viewpoint of triboelectric chargeability and the surface energy. The method of coating the core material by the resin includes, for example, a method including the steps of dissolving or suspending a coating material such as a resin in a solvent, and applying the resulting solution or suspension to the core material to allow the resin to adhere thereto; a method including the step of simply mixing the core material with the resin in powdery forms; and the like, and is not particularly limited.

The carrier has a volume-average particle size of preferably from 50 to 80 μm, and more preferably from 55 to 70 μm, and even more preferably from 55 to 65 μm, from the viewpoint of carrier scattering and developability.

In the two-component developer obtained by mixing the toner and the carrier, a weight ratio of the toner to the carrier, i.e., toner/carrier, is preferably from 1/99 to 10/90, and more preferably from 5/95 to 7/93.

The method of forming fixed images of the present invention is a method including the step of applying the toner for electrostatic image development of the present invention to a non-contact fixing type image-forming apparatus. A non-contact fixing system includes a fixing device of flash fixing, oven fixing, belt nip system, and the like. Since the toner of the present invention has a weight-average molecular weight of preferably from $1.0\times10^4$ to $1.0\times10^6$, the amount of a high-molecular weight component is low. Therefore, the toner of the present invention does not necessitate a non-offset region, so that it is suitably used especially for the non-contact fixing system.

According to the method of forming fixed images of the present invention, fixed images can be formed through known steps except that the method has a feature in the fixing step where a transferred toner image is fixed. The steps in the method of forming fixed images include, other than the fixing step, for example, the steps of forming an electrostatic latent image on the surface of a photoconductor (charging and exposing step); developing an electrostatic latent image (developing step); transferring the developed toner image to a material to which the image is transferred, such as paper (transferring step); removing the toner remaining on a developing member such as a photoconductive drum (cleaning step); and the like.

The toner of the present invention maintains an excellent fixed image and exhibits an excellent effect in fixing ability even in a long-term durability printing. Therefore, the toner of the present invention can obtain a stable fixed image and does not cause staining in the machine such as filming, even in continuous printing using a developing apparatus having an organic photoconductor or a high-speed image-forming apparatus with a linear speed of preferably 750 mm/sec or more, and more preferably from 1000 to 3000 mm/sec, in which durability such as prevention of filming to the photoconductor is required. Here, the linear speed refers to a processing speed of an image-forming apparatus, and is determined by sheet feeding speed in the fixing portion.

EXAMPLES

The following examples further describe and demonstrate embodiments of the present invention. The examples are given solely for the purposes of illustration and are not to be construed as limitations of the present invention.

[Softening Point of Resin]

The softening point refers to a temperature at which a half the amount of the sample flows out when plotting a downward movement of a plunger against temperature, as measured by using a flow tester (CAPILLARY RHEOMETER "CFT-500D," commercially available from Shimadzu Corporation), in which a 1 g sample is extruded through a nozzle having a diameter of 1 mm and a length of 1 mm while heating the sample so as to raise the temperature at a rate of 6° C./min and applying a load of 1.96 MPa thereto with the plunger.

[Glass Transition Temperature of Resin]

The glass transition temperature refers to a temperature of an intersection of the extension of the baseline of equal to or lower than the temperature of the endothermic highest peak and the tangential line showing the maximum inclination between the kick-off of the peak and the top of the peak, which is determined using a differential scanning calorimeter ("DSC 210," commercially available from Seiko Instruments, Inc.), by raising its temperature to 200° C., cooling the sample from this temperature to 0° C. at a cooling rate of 10° C./min, and thereafter raising the temperature of the sample at a heating rate of 10° C./min.

[Acid Value of Resin]

The acid value is determined by a method according to JIS K0070 except that only the determination solvent was changed from a mixed solvent of ethanol and ether as prescribed in JIS K0070 to a mixed solvent of acetone and toluene (volume ratio of acetone:toluene=1:1).

[Highest Temperature of Endothermic Peak of Resin]

The highest temperature of endothermic peak is determined using a differential scanning calorimeter ("DSC Q20," commercially available from TA Instruments. Japan), by raising its temperature to 200° C., cooling the hot sample from this temperature to 0° C. at a cooling rate of 10° C./min, and thereafter heating the sample so as to raise the temperature at a rate of 10° C./min.

[Volume-Median Particle Size ($D_{50}$) of Toner]

Measuring Apparatus: Coulter Multisizer II (commercially available from Beckman Coulter K.K.)

Aperture Diameter: 50 μm

Analyzing Software: Coulter Multisizer AccuComp Ver. 1.19 (commercially available from Beckman Coulter K.K.)

Electrolytic solution: "Isotone II" (commercially available from Beckman Coulter K.K.)

Dispersion: "EMULGEN 109P" (commercially available from Kao Corporation, polyoxyethylene lauryl ether, HLB: 13.6) is dissolved in the above electrolytic solution so as to have a concentration of 5% by weight, to give a dispersion.

Dispersion Conditions: Ten milligrams of a test sample is added to 5 mL of the above dispersion, and the resulting mixture is dispersed in an ultrasonic disperser for 1 minute. Thereafter, 25 mL of the electrolytic solution is added to the dispersion, and the resulting mixture is dispersed in the ultrasonic disperser for another 1 minute, to give a sample dispersion.

Measurement Conditions: The above sample dispersion is adjusted so as to have a concentration at which the particle sizes of 30,000 particles can be determined in 20 seconds by adding 100 mL of the above electrolytic solution to the above sample dispersion. Thereafter, the particle sizes of 30,000 particles are determined to obtain a volume-median particle size ($D_{50}$) from the particle size distribution.

[Weight-Average Molecular Weight of Resin Binder and Toner]

The weight-average molecular weight is obtained from the molecular weight distribution determined by the gel permeation chromatography according to the following method.

(1) Preparation of Sample Solution

A toner or a resin binder is dissolved in tetrahydrofuran, so as to have a concentration of 0.5 g/100 mL. The resulting solution is then filtered with a fluororesin filter ("FP-200," commercially available from Sumitomo Electric Industries, Ltd.) having a pore size of 2 μm to remove insoluble components, to give a sample solution.

(2) Determination of Molecular Weight

As an eluant, tetrahydrofuran is allowed to flow at a rate of 1 mL/min, and the column is stabilized in a thermostat at 40° C. One-hundred microliters of the sample solution is injected to the column to determine the molecular weight. The molecular weight of the sample is calculated on the basis of a calibration curve previously prepared. The calibration curve of the molecular weight is one prepared by using several kinds of monodisperse polystyrenes as standard samples.

Analyzer: HLC-8220GP (commercially available from Tosoh Corporation)

Column: GMHLX+G3000HXL (commercially available from Tosoh Corporation)

[Acid Value of Fatty Acid Ester of Pentaerythritol]

The acid value is determined by a method according to JIS K0070 except that only the determination solvent was changed from a mixed solvent of ethanol and ether as prescribed in JIS K0070 to a mixed solvent of acetone and toluene (volume ratio of acetone:toluene=1:1).

[Hydroxyl Value of Fatty Acid Ester of Pentaerythritol]

The hydroxyl value is determined by a method according to JIS K0070 except that only the determination solvent was changed from a mixed solvent of ethanol and ether as prescribed in JIS K0070 to a mixed solvent of acetone and toluene (volume ratio of acetone:toluene=1:1).

[Saturated Magnetization of Carrier]

(1) A carrier is filled in a plastic case with a lid with tapping, the case having an outer diameter of 7 mm (an inner diameter of 6 mm) and a height of 5 mm. The mass of the carrier is determined from the difference of the weight of the plastic case and the weight of the plastic case filled with the carrier.

(2) The plastic case filled with the carrier is set in a sample holder of a device for measuring magnetic property "BHV-50H" (V. S. MAGNETOMETER) commercially available from Riken Denshi Co., Ltd. The saturated magnetization is determined by applying a magnetic field of 79.6 kA/m, with vibrating the plastic case using the vibration function. The value obtained is calculated as the saturated magnetization per unit mass, taking into consideration the mass of the filled carrier.

Production Example 1 for Resin

Resin A

A 5-liter four-necked flask equipped with a nitrogen inlet tube, a dehydration tube, a stirrer, and a thermocouple was charged with BPA-PO, fumaric acid, a polymerization inhibitor, and an esterification catalyst, as shown in Table 1. The ingredients in the flask were reacted at 230° C. until a reaction rate reached to 90%. Thereafter, the reaction mixture was reacted at 8.3 kPa for 1 hour, to give a resin A. Incidentally, the reaction rate herein refers to a value calculated from the formula: Amount of Water Formed in Reaction (mol)/Theoretical Amount of Water Formed (mol)×100.

Production Example 2 for Resin

Resin B

A 5-liter four-necked flask equipped with a nitrogen inlet tube, a dehydration tube, a stirrer, and a thermocouple was charged with BPA-PO, terephthalic acid, and an esterification catalyst, as shown in Table 1. The ingredients in the flask were reacted at 230° C. for 5 hours, and the reaction mixture was then further reacted at 8.3 kPa for 1 hour. Thereafter, the reaction mixture was cooled to 185° C., fumaric acid and a polymerization inhibitor as shown in Table 1 were added thereto, and the mixture was reacted while the temperature was stepwise raised to 210° C. Thereafter, the reaction mixture was further reacted at 8.3 kPa, to give a resin B.

Production Example 3 for Resin

Resin C

A 5-liter four-necked flask equipped with a nitrogen inlet tube, a dehydration tube, a stirrer, and a thermocouple was charged with BPA-PO, BPA-EO, terephthalic acid, and an esterification catalyst, as shown in Table 1. The ingredients in the flask were reacted at 230° C. for 5 hours, and the reaction mixture was then further reacted at 8.3 kPa for 1 hour. Thereafter, the reaction mixture was cooled to 185° C., fumaric acid and a polymerization inhibitor as shown in Table 1 were added thereto, and the mixture was reacted while the temperature was stepwise raised to 210° C. Thereafter, the reaction mixture was further reacted at 8.3 kPa, to give a resin C.

Production Example 4 for Resin

Resin D

A 5-liter four-necked flask equipped with a nitrogen inlet tube, a dehydration tube, a stirrer, and a thermocouple was charged with BPA-PO, BPA-EO, terephthalic acid, and an esterification catalyst, as shown in Table 1. The ingredients in the flask were reacted at 230° C. for 5 hours, and the reaction mixture was then further reacted at 8.3 kPa for 1 hour. Thereafter, the reaction mixture was cooled to 185° C., fumaric acid, trimellitic anhydride, and a polymerization inhibitor as shown in Table 1 were added thereto, and the mixture was reacted while the temperature was stepwise raised to 210° C. Thereafter, the reaction mixture was further reacted at 8.3 kPa, to give a resin D.

Production Example 5 for Resin

Resin E

A 5-liter four-necked flask equipped with a nitrogen inlet tube, a dehydration tube, a stirrer, and a thermocouple was charged with BPA-PO, terephthalic acid, and an esterification catalyst, as shown in Table 1. The ingredients in the flask were reacted at 230° C. until a reaction rate reached to 90%. Thereafter, the reaction mixture was reacted at 8.3 kPa for 1 hour, to give a resin E.

TABLE 1

| | Resin A | Resin B | Resin C | Resin D | Resin E |
|---|---|---|---|---|---|
| Alcohol Component | | | | | |
| BPA-PO[1)] | 100 | 100 | 65 | 70 | 100 |
| BPA-EO[2)] | — | — | 35 | 30 | — |
| Carboxylic Acid Component | | | | | |
| Fumaric Acid | 100 | 70 | 50 | 32 | — |
| Terephthalic Acid | — | 30 | 40 | 50 | 85 |
| Trimellitic Anhydride | — | — | — | 18 | — |
| Esterification Catalyst | | | | | |
| Dibutyltin Oxide | 0.5 | 0.5 | 0.5 | 0.5 | 0.5 |
| Polymerization Inhibitor | | | | | |
| Hydroquinone | 0.05 | 0.05 | 0.05 | 0.05 | — |
| Softening Point (° C.) | 100.3 | 103.5 | 104.3 | 105.1 | 100.3 |
| Glass Transition Temp. (° C.) | 59.8 | 60.5 | 65.5 | 65.1 | 64.5 |
| Acid Value (KOHmg/g) | 20.1 | 10.6 | 5.3 | 25.2 | 12.3 |
| Highest Temperature of Endothermic Peak (° C.) | 69.1 | 70.2 | 74.8 | 74.5 | 73.8 |
| Index of Crystallinity | 1.45 | 1.47 | 1.39 | 1.41 | 1.36 |
| Weight-Average Molecular Weight | $1.4 \times 10^4$ | $1.3 \times 10^4$ | $8.9 \times 10^3$ | $1.5 \times 10^6$ | $6.5 \times 10^3$ |

Note)

The amounts of the alcohol components and the carboxylic acid components used are expressed in a molar ratio, and the amounts of the esterification catalyst and the polymerization inhibitor used are expressed in parts by weight, based on 100 parts by weight of the total amount of the raw material monomers (the alcohol components and the carboxylic acid components).

[1)]Propylene oxide adduct of bisphenol A (2.2 moles)

[2)]Ethylene oxide adduct of bisphenol A (2.2 moles)

Production Example 1 for Ester Compound

Pentaerythritol Stearate

A four-necked round-bottom flask equipped with a stirrer, a thermocouple, and a nitrogen inlet tube was charged with 4 moles of stearic acid per 1 mole of pentaerythritol. The ingredients in the flask were heated at 130° C. for 5 hours under a nitrogen atmosphere, to carry out an esterification reaction.

The reaction product was purified with methyl ether, to give pentaerythritol stearate. Here, the resulting compound had an acid value of 0.3 mgKOH/g, and a hydroxyl value of 1.8 mgKOH/g.

Production Example 2 for Ester Compound

Pentaerythritol Behenate

The same procedures as in Production Example 1 for Ester Compound were carried out except that 4 moles of behenic acid were used in place of 4 moles of stearic acid, to give pentaerythritol behenate. Here, the resulting compound had an acid value of 0.4 mgKOH/g, and a hydroxyl value of 1.6 mgKOH/g.

Production Example 3 for Ester Compound

Pentaerythritol Myristate

The same procedures as in Production Example 1 for Ester Compound were carried out except that 4 moles of myristic acid were used in place of 4 moles of stearic acid, to give pentaerythritol myristate. Here, the resulting compound had an acid value of 0.1 mgKOH/g, and a hydroxyl value of 1.1 mgKOH/g.

Production Example 4 for Ester Compound

Pentaerythritol Cerotate

The same procedures as in Production Example 1 for Ester Compound were carried out except that 4 moles of cerotic acid were used in place of 4 moles of stearic acid and that the reaction time was changed from 5 hours to 8 hours, to give pentaerythritol cerotate. Here, the resulting compound had an acid value of 1.2 mgKOH/g, and a hydroxyl value of 2.4 mgKOH/g.

Production Example 5 for Ester Compound

Behenyl Behenate

A four-necked round-bottom flask equipped with a stirrer, a thermocouple, and a nitrogen inlet tube was charged with 1 mole of behenic acid per 1 mole of behenyl alcohol. The ingredients in the flask were heated at 130° C. for 3 hours under a nitrogen atmosphere, to carry out an esterification reaction. The reaction product was purified with methyl ether, to give behenyl behenate. Here, the resulting compound had an acid value of 0.1 mgKOH/g, and a hydroxyl value of 1.2 mgKOH/g.

Examples 1 to 4 and Comparative Examples 1 to 11

The amount 100 parts by weight of the resin binder and 2 parts by weight of the additive as shown in Table 2, 3 parts by weight of "T-77" (commercially available from Hodogaya Chemical Co., Ltd, iron-azo dye) as a negatively chargeable charge control agent, and 6 parts by weight of a carbon black "NIPEX60" (commercially available from Degussa) as a colorant, were mixed with a Henschel mixer for 60 seconds. Thereafter, the mixture was melt-kneaded using a twin-screw extruder. Thereafter, the melt-kneaded product was cooled, and roughly pulverized with a hammer-mill. The resulting roughly pulverized product was finely pulverized with an air-jet type pulverizer, and the pulverized product was classified with an airflow classifier, to give a negatively chargeable mother toner particles having a volume-median particle size ($D_{50}$) of 8.5 μm.

The amount 100 parts by weight of the resulting mother toner particles were mixed with 0.6 parts by weight of a hydrophobic silica "R-972" (commercially available from Nippon Aerosil) and 1.0 part by weight of a hydrophobic silica "NAX50" (commercially available from Nippon Aerosil) with a Henschel mixer for 3 minutes, to give toners of Examples 1 to 4 and Comparative Examples 1 to 11.

In addition, for toners of Examples 1 to 4 and Comparative Examples 1 to 11, 6 parts by weight of each of toners and 94 parts by weight of a ferrite carrier (volume-average particle size: 60 μm, saturated magnetization: 68 $Am^2/kg$) were mixed, to give a two-component developer. Tests of the following Test Examples 1 to 4 were carried out using the resulting two-component developer. The results are shown in Table 2.

Test Example 1

Low-Temperature Fixing Ability

The resulting two-component developer was loaded in a copy machine "AR-505" (commercially available from Sharp Corporation), and the copy machine was adjusted so that the amount of toner was 0.6 $mg/cm^2$. Thereafter, an image was taken out in a step before fixing the image, to give an unfixed image. Further, using an external fixing device which was a modified fixing device of a non-contact fixing type image-forming apparatus "VarioStream 9000" (commercially available from Oce Printing Systems GmbH), at a linear speed of 1000 mm/sec, the temperature on the sheet was sequentially raised from 90° C. to 150° C., to give fixed images. A "UNICEF Cellophane" (commercially available from MITSUBISHI PENCIL CO., LTD., width: 18 mm, JISZ-1522) was adhered to each of the images fixed at each temperature, and a pressure was applied on a tape with a roller so that a load of 500 g was applied. Thereafter, the tape was stripped away, and image densities before and after strip-away of the tape were determined.

Image densities were determined at 5 points on the image printed portion with a colorimeter "Gretag Macbeth Spectroeye" (commercially available from Gretag Macbeth AG), and the average value thereof was calculated as an image density (ID).

The temperature on the sheet at which the ratio of the image densities, i.e., after strip-away of the tape/before adhesion of the tape, initially exceeded 90% was defined as the lowest fixing temperature, to evaluate low-temperature fixing ability. The lowest fixing temperature is judged as good when the temperature is lower than 100° C. The results are shown in Table 2. The sheets used for a fixing test were cardboard commercially available from Sharp Corporation "CopyBond SF-70NA" (75 $g/m^2$).

Test Example 2

Sheet Rubbing Property

A white sheet was wound around a 500 g weight of which bottom had a size of 20 mm×20 mm. The weight was placed on the black solid portion of the printed sheet fixed at the lowest fixing temperature in Test Example 1, so that the sheets were rubbed each other, and the weight was moved backward and forward 2 times between the width of 14 cm. Thereafter, the sheet was stripped away from the weight. An average value of 4 points of image densities on a portion which was rubbed was defined as Db, and an average value of 4 points of image densities on a portion which was not rubbed was defined as Dw. The difference ΔD (Db−Dw) was calculated, to evaluate sheet rubbing property. It is shown that, the smaller the value of ΔD is, the better sheet rubbing property is. The blank sheets used for a sheet rubbing test were cardboard commercially available from Sharp Corporation "CopyBond SF-70NA" (75 g/m$^2$), as same as the sheets used in Test Example 1. The results are shown in Table 2.

Test Example 3

Toner Spent

A two-component developer was loaded on a non-magnetic two-component developing type image-forming apparatus "VarioStream 9000" (commercially available from Oce Printing Systems GmbH), and fixed images were durably printed at a printing ratio of 9% and a linear speed of 1000 mm/sec, for 30 hours. Thereafter, the amount of toner spent was determined in accordance with the following method. The results are shown in Table 2.

(1) A two-component developer is passed through a mesh having a sieve opening of 20 μm with a vacuum cleaner. The amount of carbon on the remaining carrier is determined with a carbon analyzer (carbon analyzer, commercially available from HORIBA, Ltd.).

(2) The carrier of which amount of carbon was determined in item (1) is washed with chloroform, to remove a toner adhered to the carrier. After washing, the amount of carbon on the carrier is determined.

(3) The value obtained by subtracting the amount of carbon determined in item (2) from the amount of carbon determined in item (1) is defined as the amount of toner spent. In the table, the amount of toner spent is expressed in % by weight based on the carrier.

Test Example 4

Filming Resistance

After fixed images were durably printed for 30 hours in the Test Example 3, the presence or absence of filming to an organic photoconductor was visually observed. The filming resistance was evaluated according to the following evaluation criteria. The results are shown in Table 2.

[Evaluation Criteria of Filming Resistance]

◎: No filming is found at all.

○: Filming is slightly found.

X: Filming is found.

TABLE 2

| | Raw Materials for Toner | | Physical Properties of Toner | | Properties of Two-Component Developer | | | |
|---|---|---|---|---|---|---|---|---|
| | Resin Binder | Additive | Weight-Average Molecular Weight | Amount of Toner Particles in Which Wax Has Dispersion Diameter of 0.3 to 0.8 μm (% by Number) | Lowest Fixing Temperature (° C.) | Sheet Rubbing Property | Amount of Toner Spent (% by Weight) | Filming Resistance |
| Ex. 1 | Resin A | Pentaerythritol Behenate | $1.5 \times 10^4$ | 84 | 96 | 0.12 | 0.08 | ◎ |
| Ex. 2 | Resin A | Pentaerythritol Stearate | $1.5 \times 10^4$ | 82 | 99 | 0.13 | 0.09 | ◎ |
| Ex. 3 | Resin B | Pentaerythritol Behenate | $1.3 \times 10^4$ | 71 | 97 | 0.12 | 0.12 | ◎ |
| Ex. 4 | Resin B | Pentaerythritol Stearate | $1.3 \times 10^4$ | 76 | 99 | 0.14 | 0.15 | ◎ |
| Comp. Ex. 1 | Resin E | Pentaerythritol Behenate | $8.3 \times 10^3$ | 44 | 94 | 0.14 | 0.45 | X |
| Comp. Ex. 2 | Resin E | Pentaerythritol Stearate | $8.3 \times 10^3$ | 54 | 97 | 0.14 | 0.49 | X |
| Comp. Ex. 3 | Resin A | Pentaerythritol Myristate | $1.5 \times 10^4$ | 64 | 105 | 0.08 | 0.18 | ○ |
| Comp. Ex. 4 | Resin A | Pentaerythritol Cerotate | $1.5 \times 10^4$ | 62 | 97 | 0.16 | 0.32 | X |
| Comp. Ex. 5 | Resin A | Behenyl Behenate | $1.5 \times 10^4$ | 38 | 105 | 0.12 | 0.12 | ○ |
| Comp. Ex. 6 | Resin A | Carnauba Wax C1 | $1.5 \times 10^4$ | 32 | 101 | 0.17 | 0.35 | ◎ |
| Comp. Ex. 7 | Resin A | HNP-9 | $1.4 \times 10^4$ | 15 | 106 | 0.18 | 0.72 | X |
| Comp. Ex. 8 | Resin C | Pentaerythritol Behenate | $9.1 \times 10^3$ | 64 | 95 | 0.10 | 0.31 | ○ |
| Comp. Ex. 9 | Resin C | Pentaerythritol Stearate | $9.1 \times 10^3$ | 72 | 96 | 0.11 | 0.33 | ○ |
| Comp. Ex. 10 | Resin D | Pentaerythritol Behenate | $1.5 \times 10^5$ | 28 | 103 | 0.09 | 0.07 | ◎ |
| Comp. Ex. 11 | Resin D | Pentaerythritol Stearate | $1.5 \times 10^5$ | 24 | 104 | 0.09 | 0.08 | ◎ |

*) "Carnauba Wax C1" (carnauba wax, commercially available from Kato Yoko) "HNP-9" (paraffin wax, commercially available from Nippon Seiro)

It can be seen from the above results that Examples 1 to 4 are excellent in low-temperature fixing ability and sheet rubbing property even when a non-contact fixing type developing machine is used, generate no filming even when a high-speed two-component developing machine is used, and generate few toner spent even after durable printing, therefore, an excellent image is obtained, as compared to Comparative Examples 1 to 11. In addition, it can be seen from the comparisons of Examples 1 and 3 with Examples 2 and 4 that generation of toner spent is lower in a case where the toner contains a fatty acid ester of which constituent fatty acid is behenic acid rather than stearic acid, among esters of pentaerythritol and a fatty acid having 15 to 25 carbon atoms.

The toner for electrostatic image development of the present invention is suitably used for, for example, developing a latent image formed in electrophotography, electrostatic recording method, electrostatic printing method, or the like.

The present invention being thus described, it will be obvious that the same may be varied in ways. Such variations are not to be regarded as a departure from the spirit and scope of the invention, and all such modifications as would be obvious to one skilled in the art are intended to be included within the scope of the following claims.

What is claimed is:

1. A toner for electrostatic image development, comprising a resin binder and a wax, wherein the resin binder comprises 100% by weight, based on the weight of said resin binder, of an amorphous polyester obtained by polycondensing a carboxylic acid component comprising fumaric acid in an amount of from 70 to 100% by mole, with an alcohol component, wherein the wax comprises from 1 to 5 parts by weight based on 100 parts by weight of the resin binder of an ester of pentaerythritol and a fatty acid having 16 to 24 carbon atoms.

2. The toner according to claim 1, comprising toner particles in which the wax has a dispersion diameter of from 0.3 to 0.8 μm in an amount of 70% by number or more.

3. The toner according to claim 1, wherein the resin binder has a weight-average molecular weight determined by the gel permeation chromatography of from $1.0\times10^4$ to $1.0\times10^6$ calculated as polystyrene.

4. A method of forming fixed images, comprising the step of applying the toner for electrostatic image development as defined in claim 1 to a non-contact fixing type image-forming apparatus.

5. The method according to claim 4, wherein the image-forming apparatus has a linear speed of 750 mm/sec or more.

6. The toner according to claim 1, wherein said fatty acid having 16 to 24 carbon atoms is selected from the group consisting of palmitic acid, stearic acid, arachic acid, behenic acid, lignoceric acid, oleic acid, and linoleic acid.

7. The toner according to claim 1, wherein said fatty acid has 18 to 22 carbon atoms.

8. The toner according to claim 1, wherein said fatty acid has 17 to 23 carbon atoms.

9. The toner according to claim 1, wherein said ester of pentaerythritol and a fatty acid having 16 to 24 carbon atoms has a degree of esterification ranging from 0.8 or more to 1.0.

10. The toner according to claim 1, wherein said ester of pentaerythritol and a fatty acid having 16 to 24 carbon atoms has an acid value and a hydroxyl value of 5 mgKOH/g or less.

11. The toner according to claim 1, wherein said ester of pentaerythritol and a fatty acid having 16 to 24 carbon atoms has an acid value and a hydroxyl value of from 0.1 to 3 mgKOH/g.

12. The toner according to claim 1, wherein said ester of pentaerythritol and a fatty acid having 16 to 24 carbon atoms in the toner has a volume-average dispersion diameter of preferably from 0.1 to 5 μm.

13. The toner according to claim 1, wherein said pentaerythritol and a fatty acid having 16 to 24 carbon atoms is contained in an amount of from 1 to 4 parts by weight, based on 100 parts by weight of the toner.

14. The toner according to claim 1, wherein said pentaerythritol and a fatty acid having 16 to 24 carbon atoms is contained in an amount of from 50% by weight or more of the total amount of the wax.

15. The toner according to claim 1, wherein said alcohol component is an alkylene oxide adduct of bisphenol represented by the formula (I):

(I)

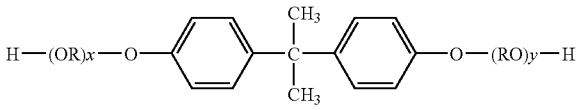

wherein RO is an alkyleneoxy group; R is an alkylene group having 2 or 3 carbon atoms; x and y are positive numbers showing an average number of moles of alkylene oxide added, wherein a sum of x and y is from 1 to 16.

16. The toner according to claim 1, further comprising a colorant and a charge control agent.

* * * * *